US006860666B2

(12) United States Patent
Chien

(10) Patent No.: US 6,860,666 B2
(45) Date of Patent: Mar. 1, 2005

(54) PEN HAVING CASCADED CARTRIDGES OF DIFFERENT COLORS

(76) Inventor: Wen Tsune Chien, 1F, No. 45, Dongyang St., Shulin City, Taipei County 238 (TW)

( * ) Notice: Subject to any disclaimer, the term of this patent is extended or adjusted under 35 U.S.C. 154(b) by 0 days.

(21) Appl. No.: 10/837,634

(22) Filed: May 4, 2004

(65) Prior Publication Data

US 2004/0223800 A1 Nov. 11, 2004

(30) Foreign Application Priority Data

May 5, 2003 (TW) ..... 92208178

(51) Int. Cl.[7] ..... B43K 21/14; B43K 27/02
(52) U.S. Cl. ..... 401/57; 401/17; 401/19
(58) Field of Search ..... 401/16, 17, 19, 401/29, 56, 57

(56) References Cited

U.S. PATENT DOCUMENTS 3,338,215 A * 8/1967 Fu Chin et al. ..... 401/82
3,708,235 A * 1/1973 Kolomeir ..... 401/57
3,761,188 A * 9/1973 Chin-Chih ..... 401/57

* cited by examiner

*Primary Examiner*—David J. Walczak
(74) *Attorney, Agent, or Firm*—Rosenberg, Klein & Lee

(57) ABSTRACT

A pen comprises a plurality of cartridges matingly cascaded together along a bore thereof, the stick of each cartridge having a color different that of others, two inner opposite protrusions adjacent a bottom end of the pen, the protrusions being adapted to fasten the lowest cartridge, and two opposite recesses at the bottom end of the pen; and a releasable pen. Removing the lowest cartridge and inserting the cartridge into a top end of the pen will push the lowest cartridge out of the pen. Alternatively, engaging the lowest cartridge with another cartridge prior to pushing upwardly will remove the topmost cartridge from the pen. The top end of the topmost cartridge is either projected from the top end of the pen or flush therewith. Also, the hand of a user is prevented from being contaminated by the stick while removing the same.

2 Claims, 6 Drawing Sheets

PEN HAVING CASCADED CARTRIDGES OF DIFFERENT COLORS

BACKGROUND OF THE INVENTION

1. Field of the Invention

The present invention relates to pens and more particularly to an improved pen having a plurality of easily removable cartridges of different colors being cascaded together.

2. Description of Related Art

A variety of pens are commercially available. Most pens are designed for facilitating writing while some having additional features such as aesthetic appearance. Currently, there are removable pens available. The pen comprises a plurality of short cartridges matingly cascaded together along the hollow bar thereof. The cartridges can be classified as ones having graphite sticks of same color similar to pencils, ones having soft sticks of different colors formed of a fluorescent material similar to markers, and ones having wax sticks of different colors similar to crayons. In use, simply continuously push a cartridge into the top of the pen until a cartridge having a desired color is appeared at the bottom of the pen.

Such removable pens are gaining popularity recently. However, the well known pens suffered from a couple of disadvantages. In a case of the hand of a user exerted force upon a portion of the cartridge while removing the cartridge, the hand tends to be contaminated by the graphite, wax, or fluorescent material of the stick. Typically, it is difficult of washing off the contaminant. Moreover, the portion of the cartridge held by the hand is relatively small, resulting in a difficulty of removing the cartridge. Hence, a need for improvement exists.

SUMMARY OF THE INVENTION

It is an object of the present invention to provide a pen having a plurality of easily removable cartridges of different colors being cascaded together. Also, the hand of a user is prevented from being contaminated by the stick of the cartridge while removing the same.

To achieve the above and other objects, the present invention provides a pen comprising an elongated, hollow bar including a plurality of cartridges matingly cascaded together along a bore thereof, each cartridge having a projected stick adapted to insert into a top end of another cartridge and the stick of each cartridge having a color different that of others, two opposite protrusions on an inner surface adjacent a bottom end of the bar, the protrusions being adapted to fasten one of a plurality of recessed portions of the cartridge in a lowest position of the bar, and two opposite recesses at the bottom end of the bar; and a cap releasably covered on the bottom end of the bar; whereby either removing the lowest cartridge and inserting the cartridge into a top end of the bar will push the lowest cartridge out of the bar or engaging the lowest cartridge with another cartridge prior to pushing upwardly will remove the topmost cartridge from the bar.

In one aspect of the present invention the top end of the topmost cartridge is either projected from the top end of the bar or flush therewith.

The above and other objects, features and advantages of the present invention will become apparent from the following detailed description taken with the accompanying drawings.

DETAILED DESCRIPTION OF THE PREFERRED EMBODIMENTS

Figure 1:
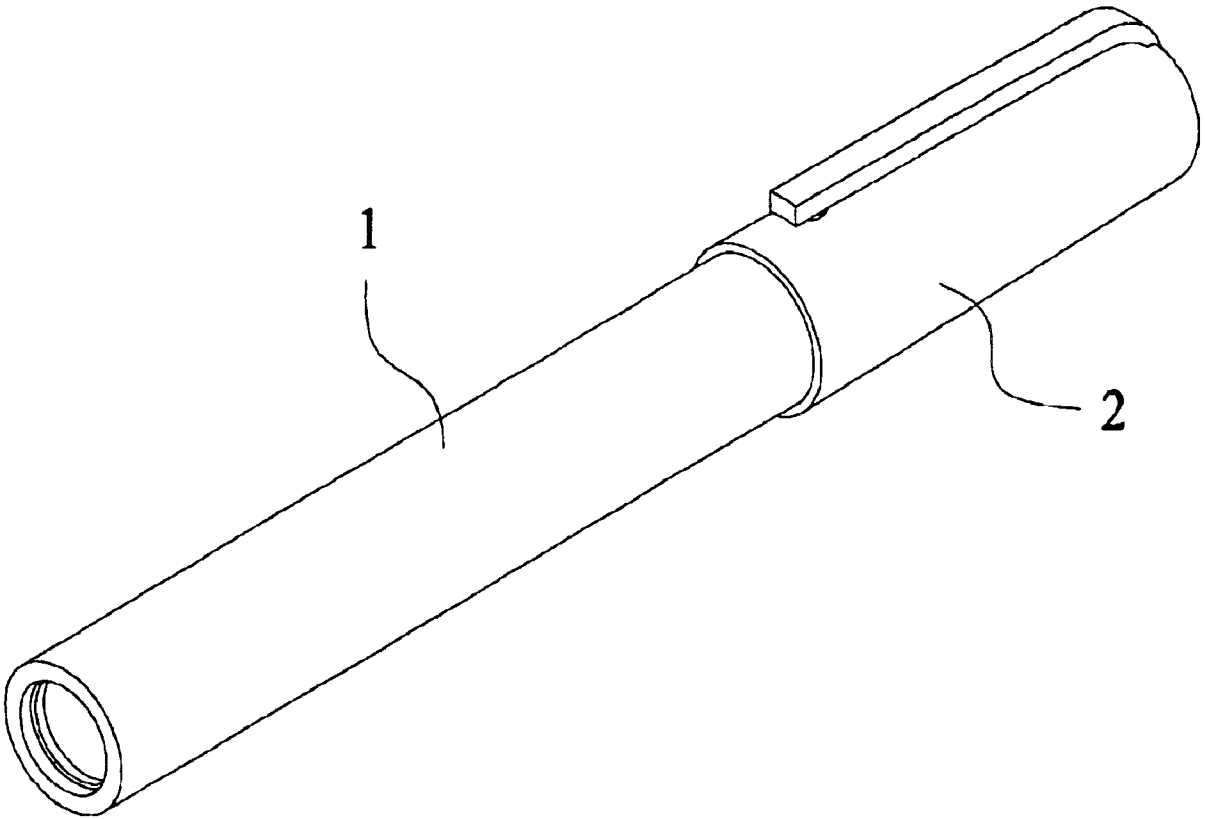
FIG. 1 is a perspective view of a pen according to the invention.
Figure 2:
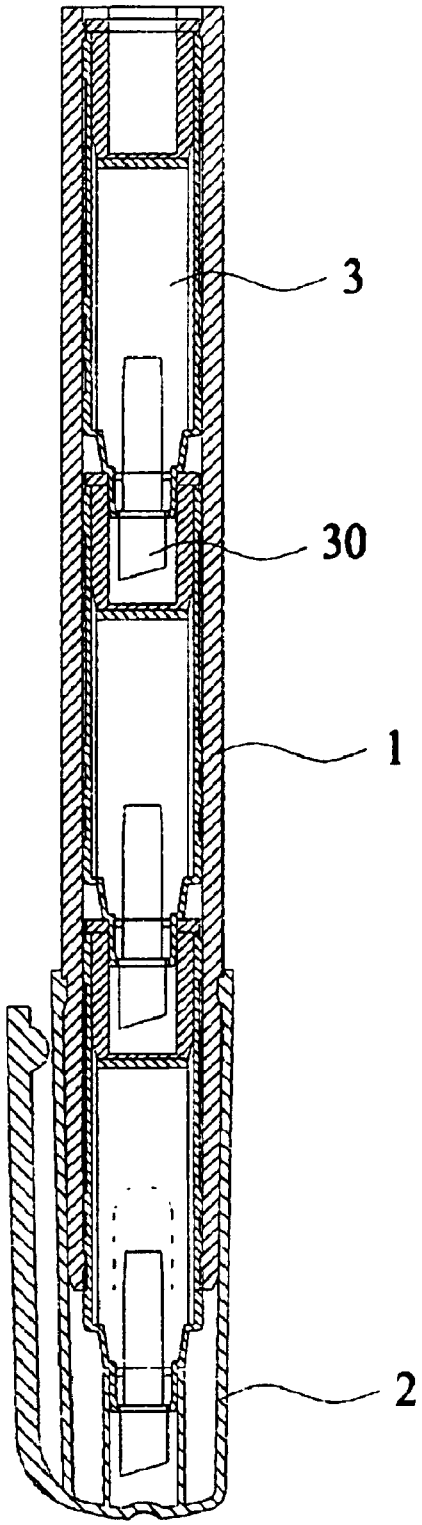
FIG. 2 is a longitudinal sectional view of the pen.
Figure 3:
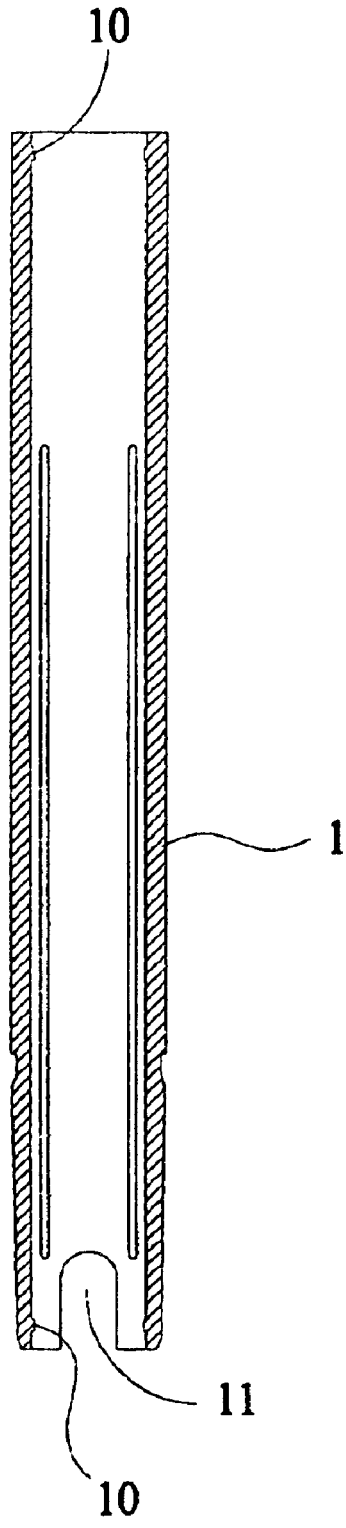
FIG. 3 is a view similar to FIG. 2 with both the cap and the cartridges removed.
Figure 4:
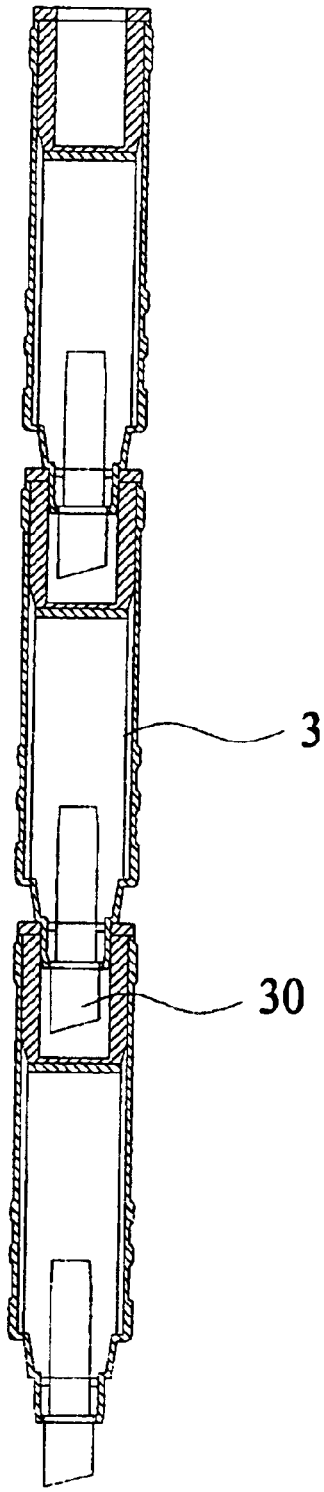
FIG. 4 is a sectional view of the cascaded cartridges.

Referring to FIGS. 1 to 5, a pen constructed in accordance with the invention is shown. The pen comprises an elongated, hollow, and cylindrical bar 1 and a cap 2. Each component will be described in detail below.

A plurality of short cartridges 3 are matingly cascaded together along the bore of the bar 1. Each cartridge 3 has a projected stick 30 adapted to insert into the top of another cartridge 3. The stick 30 of each cartridge 3 has a color different that of others. The cap 2, as a protection of the stick 30 of the cartridge 3, is releasably covered on the bottom end of the pen.

The bar 1 comprises two opposite protrusions 10 on an inner surface adjacent its bottom end. The protrusions 10 act to fasten one of a plurality of recessed portions of the lowest cartridge 3 so as to prevent it from being accidentally removed. Also, two opposite, arcuate recesses 11 are formed at the bottom end of the bar 1 so as to expose more portions of the cartridge 3, resulting in a facilitation of removing the lowest cartridge 3 by holding such portions by the hand. Moreover, the hand of a user may hold portions of the cartridge 3 exposed on the recesses 11 so as to prevent the hand from being contaminated by the graphite, wax, or fluorescent material of the stick 30.

Operations of removing the cartridge 3 and inserting the cartridge 3 will now be described in detail below. A user may hold the bar 1 with one hand and remove the lowest cartridge 3 with the other hand. Next, insert the cartridge 3 into a top end of the bar 1 for pushing the cartridges 3 downwardly so as to expose the lowest cartridge 3. Such procedure may continue until a cartridge 3 having a desired color becomes the lowest cartridge 3. Alternatively, a user may remove the cartridge 3 and insert the cartridge 3 in an order contrary to the above. In detail, a user may hold the bar 1 with one hand and engage the lowest cartridge 3 with another cartridge 3 prior to pushing upwardly. This can remove the topmost cartridge 3 from the bar 1. Such procedure may continue until a cartridge 3 having a desired color becomes the lowest cartridge 3. The latter is particularly suitable for a desired cartridge 3 proximate the top end of the bar 1.

Figure 5:
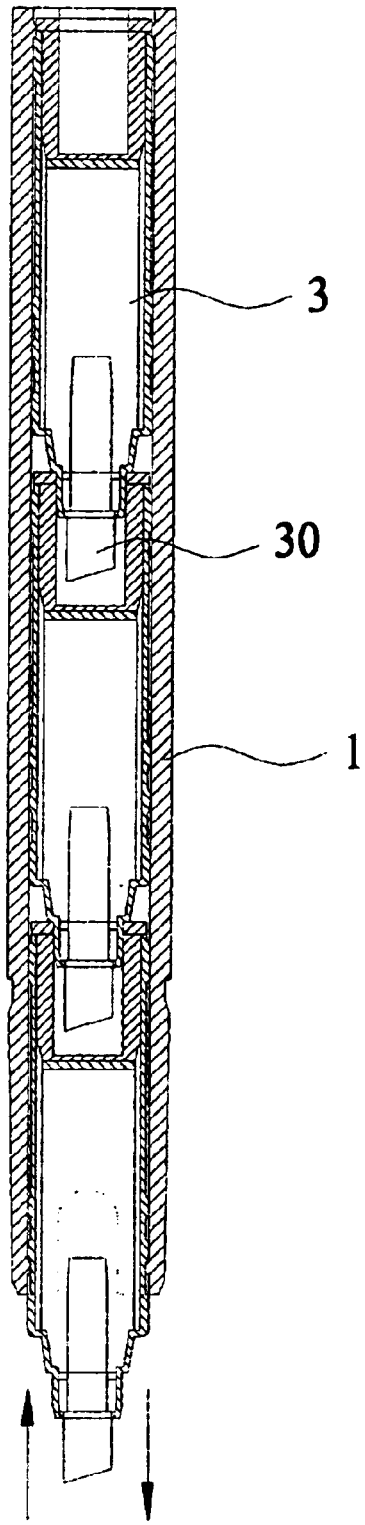
FIG. 5 is a sectional view of the cartridges cascaded together along the hollow bar of the pen in a first preferred embodiment.
Figure 6:
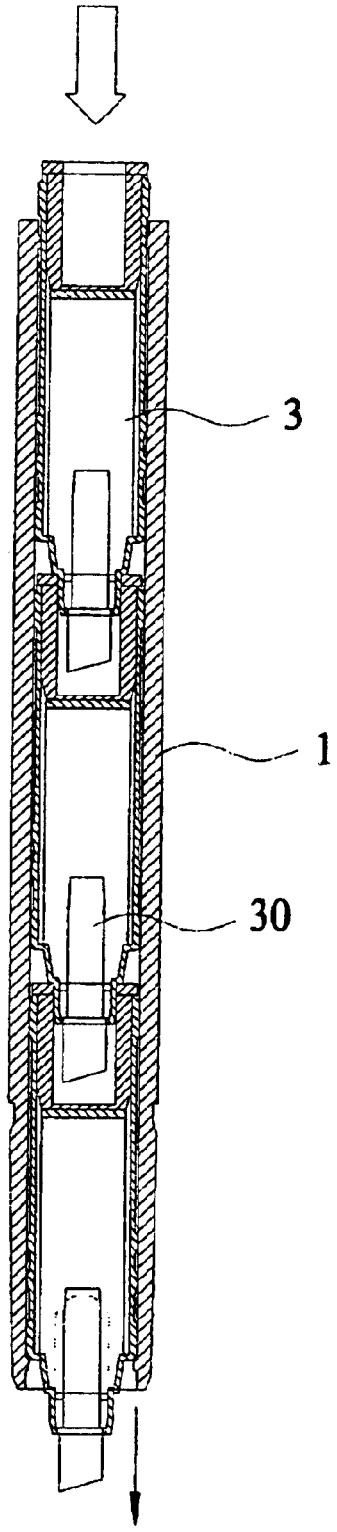
FIG. 6 is a view similar to FIG. 5 where the cartridges are cascaded together along the hollow bar of the pen in a second preferred embodiment.

Referring to FIG. 6, there is shown a second preferred embodiment of the cartridges 3 different from that shown in the first preferred embodiment of FIG. 5. The cartridges 3 of the second preferred embodiment are longer than that of the first preferred embodiment so that a top portion of the topmost cartridge 3 is projected from the top end of the bar 1. This is a contrast to the flush top end of the bar 1 when the cartridges 3 are loaded therein (see the embodiment of FIG. 5). The second embodiment may further facilitate the insertion of the cartridge 3 into the top end of the bar 1 during the cartridge removal and insertion process.

While the invention herein disclosed has been described by means of specific embodiments, numerous modifications and variations could be made thereto by those skilled in the art without departing from the scope and spirit of the invention set forth in the claims.

What is claimed is:

1. A pen comprising:

an elongated, hollow bar including a plurality of cartridges matingly cascaded together along a bore thereof, each cartridge having a projected stick adapted to insert into a top end of another cartridge and the stick of each cartridge having a color different that of others, two opposite protrusions disposed on an inner surface adjacent a bottom end of the bar, the protrusions being adapted to fasten one of a plurality of recessed portions of the cartridge in a lowest position of the bar, and two opposite recesses disposed at the bottom end of the bar; and a cap releasably covered on the bottom end of the bar;

whereby either removing the lowest cartridge and inserting the cartridge into a top end of the bar will push the lowest cartridge out of the bar or engaging the lowest cartridge with another cartridge prior to pushing upwardly will remove the topmost cartridge from the bar.

2. The pen of claim 1, wherein the top end of the topmost cartridge is either projected from the top end of the bar or flush therewith.

* * * * *